United States Patent [19]

Currier

[11] 4,274,233

[45] Jun. 23, 1981

[54] BUILDING LAYOUT FOR RESTAURANT AND ARTIST WORK/EXHIBIT AREA

[76] Inventor: Glorys A. Currier, P.O. Box 34-1213, Coral Gables, Fla. 33134

[21] Appl. No.: 67,374

[22] Filed: Aug. 17, 1979

[51] Int. Cl.³ ..... E04H 3/04

[52] U.S. Cl. ..... 52/33; 52/234

[58] Field of Search ..... 52/234, 236.3, 6, 33; 186/38

[56] References Cited

U.S. PATENT DOCUMENTS

| | | | |
|---|---|---|---|
| 2,858,579 | 11/1958 | Koelb | 52/234 |
| 3,091,815 | 6/1963 | Krawiec | 52/33 X |
| 3,378,963 | 4/1968 | Obata | 52/234 X |
| 3,487,595 | 1/1970 | Schumann | 52/6 X |
| 3,696,805 | 10/1972 | Sweeten et al. | 52/234 UX |
| 3,778,911 | 12/1973 | Woolman | 52/234 X |
| 4,154,027 | 5/1979 | Searcy | 52/234 X |

*Primary Examiner*—Price C. Faw, Jr.
*Assistant Examiner*—Carl D. Friedman
*Attorney, Agent, or Firm*—Frederick L. Bergert

[57] ABSTRACT

A coordinated building layout which includes a restaurant and artist work/exhibit area is disclosed. The cooperation between the restaurant area and the artist work-/exhibit area results in maximum efficiency and space utilization. The present system enables accommodation of a wide variety of art disciplines, including the performing arts, while contributing to enjoyment of the arts by the dining patrons of the restaurant.

8 Claims, 5 Drawing Figures

BUILDING LAYOUT FOR RESTAURANT AND ARTIST WORK/EXHIBIT AREA

BACKGROUND AND SUMMARY OF THE INVENTION

The present invention relates to a building layout which includes a restaurant combined with artist functional areas for use by artists in the creation and display of their artistic works. More particularly, the present invention relates to a novel space utilization whereby an area is provided for use by artists in creating and displaying their various artistic efforts and whereby, in addition, the artist work/exhibit area is coordinated with a restaurant, with various service areas and dining areas for use by restaurant patrons as well as by the artists themselves.

Previous building structures which provide for diversity of use have included arrangements such as described in U.S. Pat. Nos. 3,778,911; 3,839,833; and 1,486,524. U.S. Pat. No. 3,778,911 relates to a classroom facility, including a first area for a learning devices center, and a second area for use in teaching psychomotor activities. U.S. Pat. No. 3,839,833 relates to a combination multiple residential apartment and service area building. U.S. Pat. No. 1,486,524 is concerned with a music store configuration which includes both a concert room and a musical instrument sales area. Other related configurations are described in U.S. Pat. Nos. 2,858,579; 3,378,963; 3,803,778; 3,992,824; and 4,041,661.

By the present invention, there is provided an improved enclosed building structure for use as a combined restaurant facility and artist work/exhibit area. The present invention is particularly advantageous for use by persons who are using the artist work/exhibit area, either as artists or patrons of the arts, and who then wish to utilize dining facilities in a nearby area. The present invention provides a building structure which includes artist work/exhibit areas and an integral restaurant having food and drink preparation and service areas as well as dining areas. Included in the structure are the ancillary spaces for the artist work/exhibit areas, such as lounge, lavatory and locker areas. In addition, ancillary spaces for the restaurant are provided, including a waiting area for diners, lounges and restrooms, coat rooms, cashier's spaces and the like. The present construction results in a high degree of efficiency, with maximum utilization of the area involved and with cooperation between the artist work/exhibit areas and the restaurant areas. Provision is also made for maximum observation by restaurant diners of the artist exhibit and work areas, in order to contribute to the decor of the restaurant and also to enhance restaurant sales as well as sales of the artists' products, such as paintings, sculptures and the like. In addition, the present invention provides for efficient and easy movement of diners and artists between the artist work/exhibit area and the restaurant areas.

BRIEF DESCRIPTION OF THE DRAWINGS

The advantages and features of the present invention will be more fully understood from the following description of the preferred embodiments, taken in conjunction with the accompanying drawings, wherein.

DESCRIPTION OF THE PREFERRED EMBODIMENTS

Figure 1A:
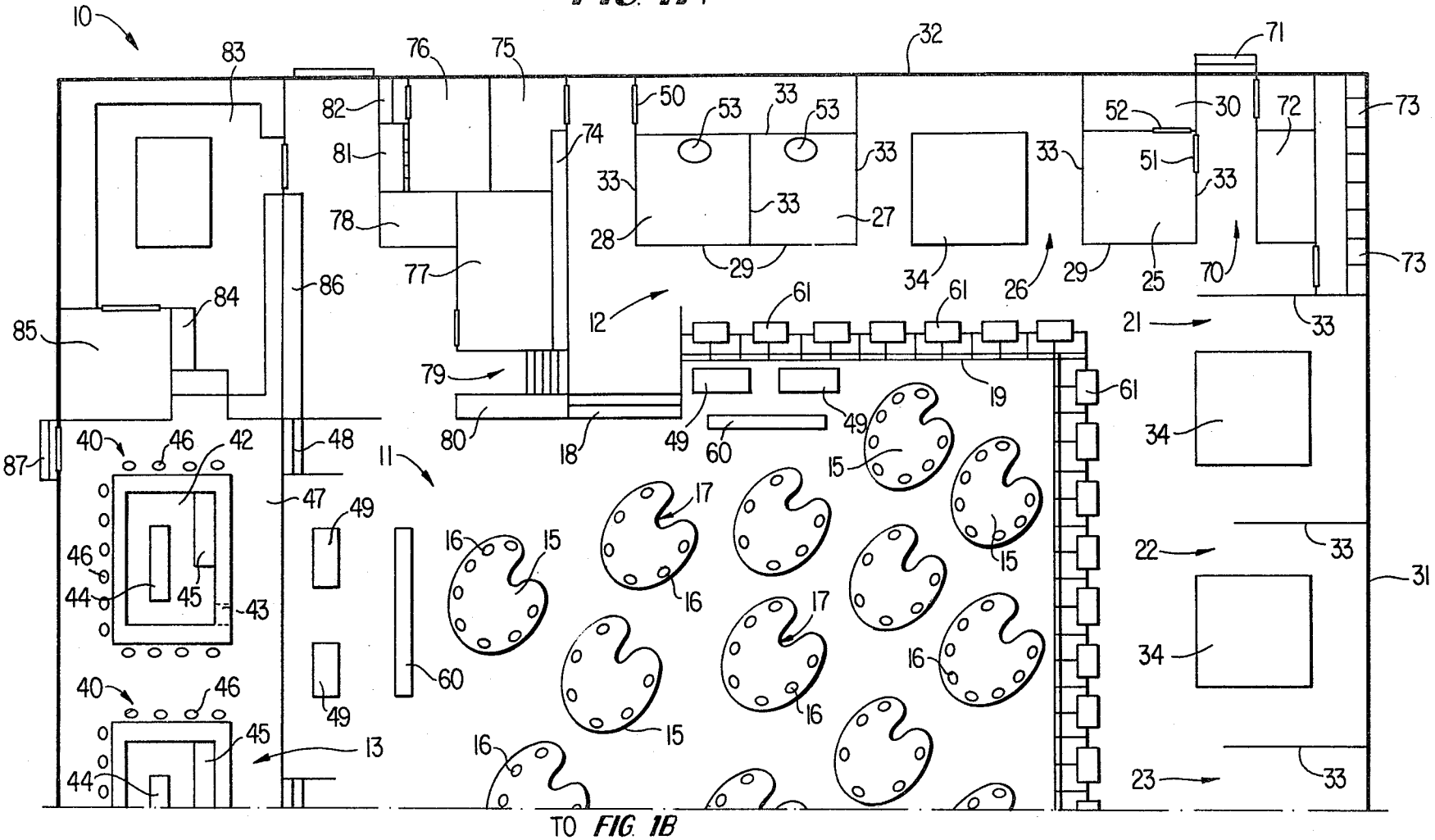
FIG. 1 is an overall schematic layout in plan view, including FIGS. 1A and 1B, showing the first or main floor of the combined restaurant and artist work/exhibit area of the present invention.
Figure 1B:
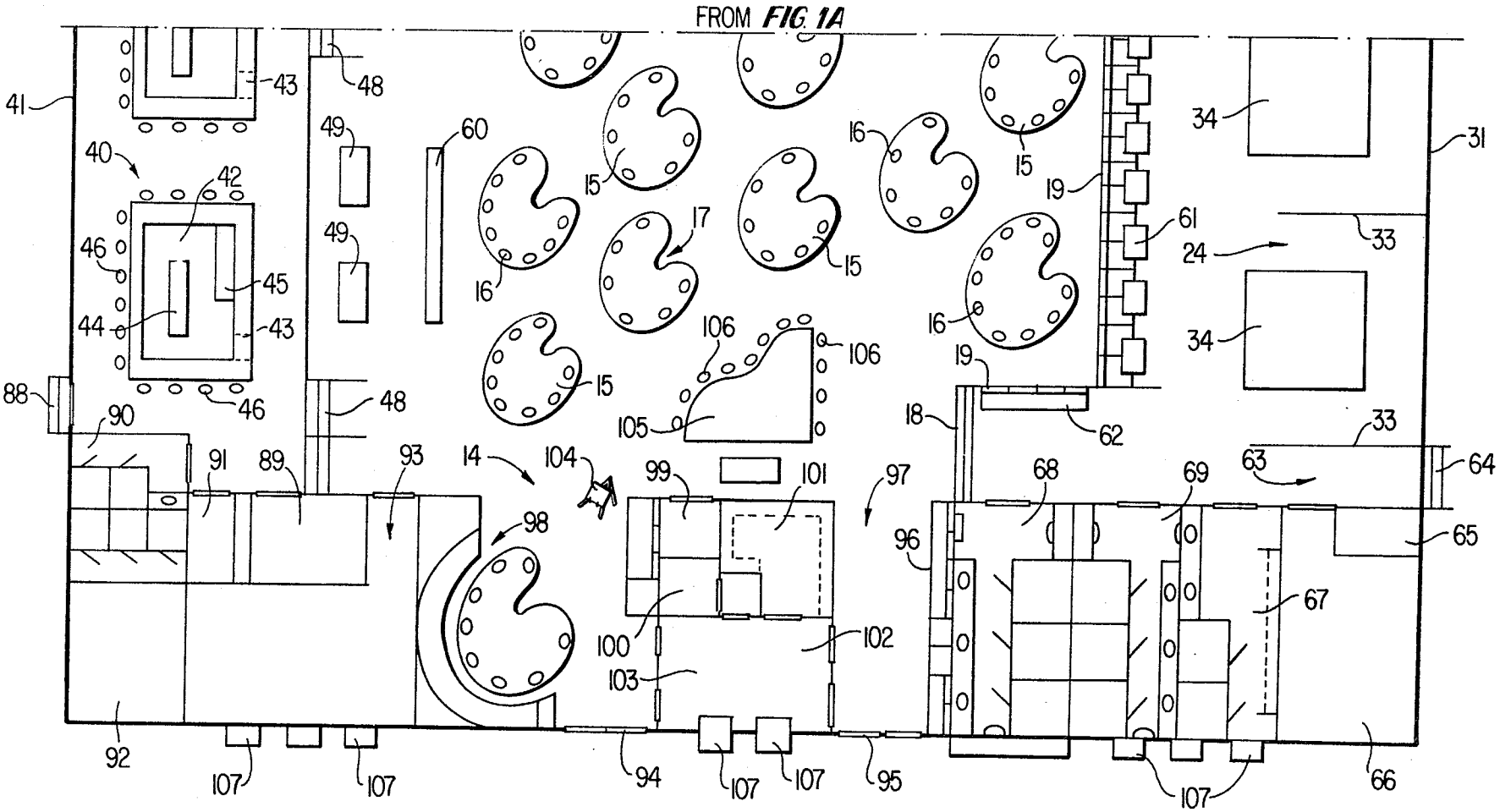
Figure 2A:
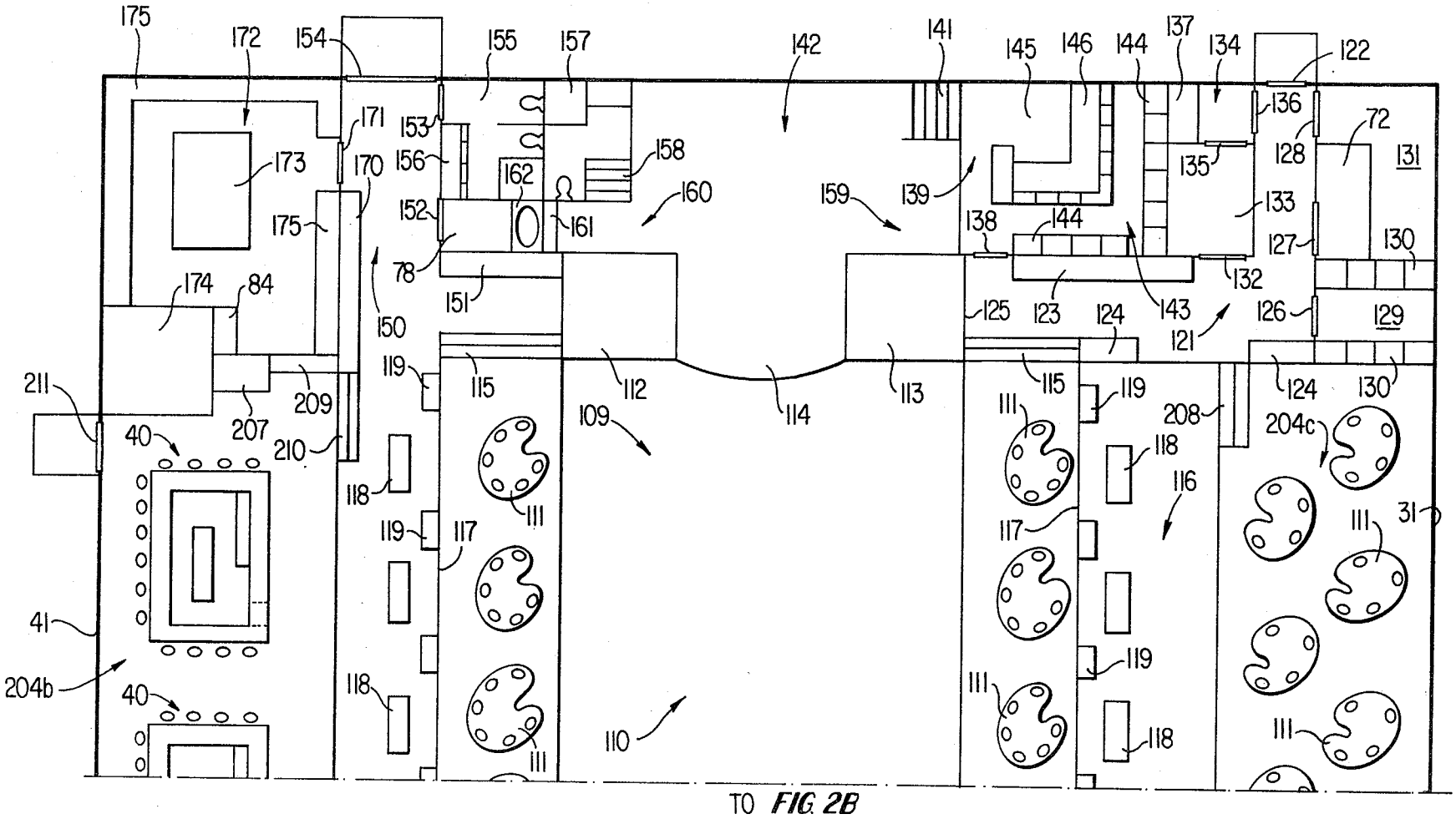
FIG. 2 is an overall schematic layout in plan view, including FIGS. 2A and 2B, showing the second floor of the combined restaurant and artist work/exhibit area of the present invention.
Figure 2B:
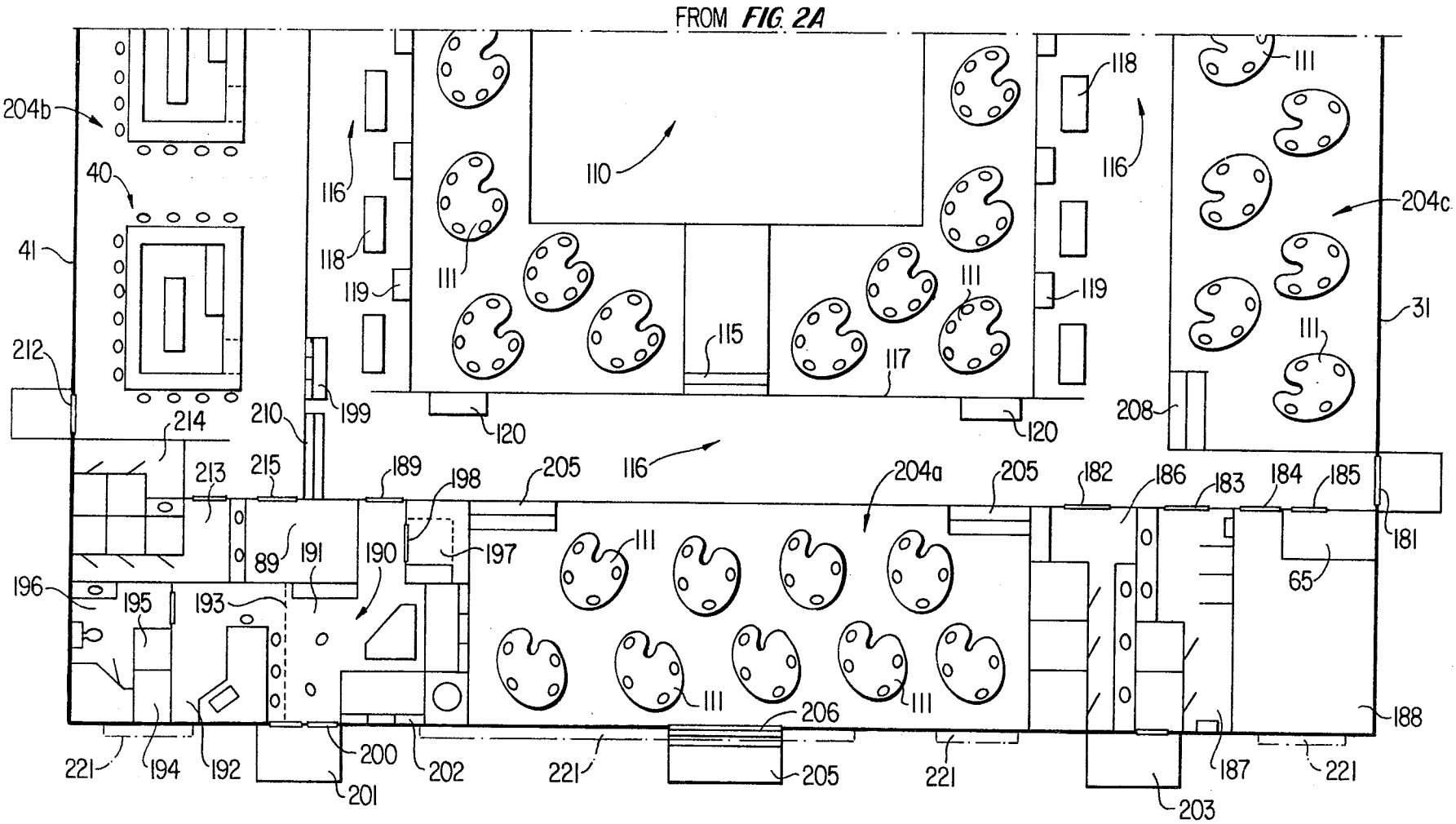
Figure 3:
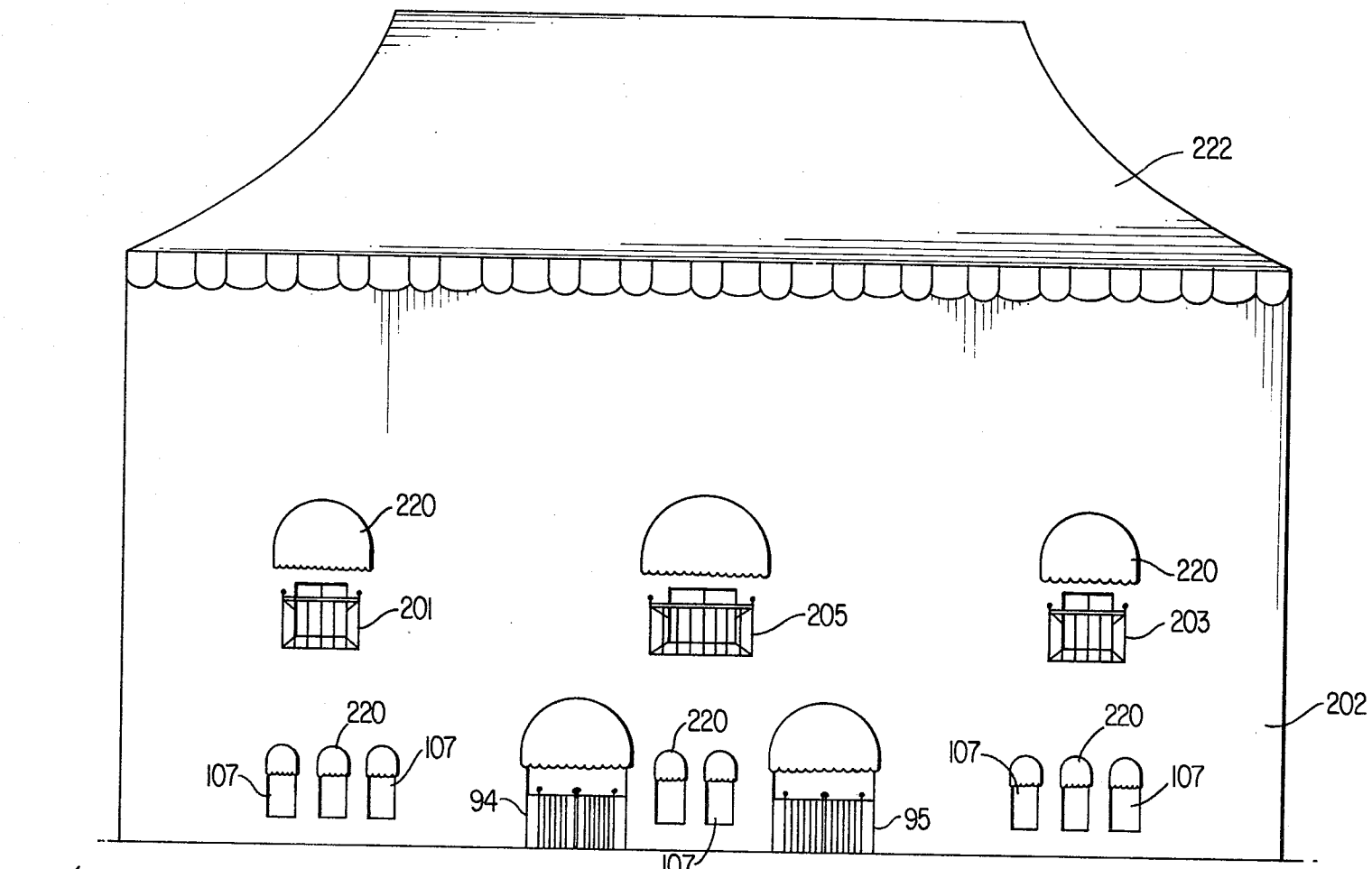
FIG. 3 is a front elevation of the combined restaurant and artist work/exhibit area of FIGS. 1 and 2.

In the embodiment of the present invention as illustrated in FIGS. 1 through 3, there is shown the combined facility 10, which includes, on the first floor thereof, the dining area 11, the artist work and exhibit area 12, the service area 13 for the dining area and the general service area 14 for the facility 10. The facility 10 is constructed by the use of common building materials and components and the construction procedures are well known in the art.

The main dining area 11 is in the form of a landscaped courtyard, enclosed by walls 19. The dining area 11 includes a plurality of tables 15, the upper horizontal surfaces of which are each in the shape of an artist's palette. The palette colors 16 are painted or otherwise set onto the table 15 surfaces to indicate the seating positions around each table 15. Any suitable base (not shown) may be provided for the tables 15 which will result in stability of the tables 15 and allow comfortable seating around the tables 15. Various sizes of tables 15 with various numbers of seating positions 16 may be employed. The palette shape of the tables 15, with the indentation 17 which projects inwardly toward the center of tables 15, provides ease of access for service by a waiter or waitress from the inner portion of the indentation 17. Chairs (not shown) are positioned around the periphery of the tables 15 to correspond with the palette colors 16. The chair cushions are preferably of the same color as the adjacent palette color 16.

At the rear of the main dining area 11 is a stairway 18 of two stairs or so, leading up to an artist work/exhibit area 12 which is slightly elevated with respect to the dining area 11. A similar stairway 18 is located at the opposite end of the area 12. As shown in FIG. 1, the area 12 is provided with a series of separate booths or studios for each of various art disciplines, including, for example, individual studios for acrylics 21, watercolor 22, graphics 23 and non-clay sculpture 24 arranged along one outer wall 31 of the facility, and studios for photography 25, pastels 26, oil painting 27 and clay sculpture 28 arranged along the adjacent outer wall 32. The barrier between the main dining area 11 and the artist work/exhibit area 12 is provided by a series of arrangements 61 containing two seats and one table, which extend continuously along the boundary between areas 11 and 12 and thus provide a barrier of a height equal to the backs of the seats in the arrangements 61. At the front of the area 12 there are located a series of seats 62.

In the construction of studios 27 and 28, a glass partition 29 is provided to form the front wall, thus facilitating the viewing of work and exhibits in these studios 27 and 28 while preventing the viewers from coming into contact with the dust and odors which are often present in work areas devoted to these art disciplines. Standard wall partitions 33 may be employed to provide the remaining walls for these studios 27, 28 and a door 50 is located to the rear of studio 28. Vent fans 53 are also advantageously located in the ceilings of these studios 27, 28 to provide for air circulation and removal of odors and dust.

The photography studio 25 is constructed as an enclosed room by the use of wall partitions 33 with glass partition 29 forming the front wall. A dark room 30 is located adjacent the studio 25 and doors 51 and 52 are provided for entry to studio 25 and for passage between the studio 25 and the darkroom 30.

The completely enclosed studios 25, 27 and 28, along with vent fans 53 in studio 27, 28 are necessary to provide a clean air environment, particularly in the vicinity of the dining patrons.

Each of the studios 21 through 24 and 26 may be constructed by the use of wall partitions 33 extending at right angles to the respective outer wall 31, 32. The partitions 33 along with a portion of the respective outer wall 31, 32 serve as a support and background for the paintings and other works which are attached thereto for exhibit. The work area 34 in each of the studios is an area which is set apart from the remainder of the studio, such as by elevating or depressing the floor area 34 relative to the remainder of the floor. The patrons viewing the exhibits are then free to walk between the work area 34 and the walls 31, 33.

On the side of the facility 10 opposite to wall 31 there are positioned a plurality of serving bars 40 for use by the waiters in serving the dining patrons. The serving bars 40 are preferably arranged in a row along wall 41 opposite to wall 31 and each bar 40 is generally rectangular in shape with the longitudinal axis of the rectangle being parallel to the wall 41. The floor area 47 adjacent the serving bars 40 is slightly elevated above the main dining area 11, and is reached by one of the stairways 48 of two or so stairs.

Each bar 40 is provided with an interior rectangular shaped work space 42. A portion 43 of the bar surface is hinged on one side in a conventional manner to allow persons working in the interior space 42 to lift said portion 43 and thus pass freely into or out of the work space 42. A table 44 with food preparation surface and a sink 45 with running water are located in the interior space 42 of each serving bar 40. A plurality of stools 46 are positioned around the periphery of the bars 40. The serving bars 40 are set up to provide order pick-up for any of various foods and drinks to be served to the dining customers.

Located on the floor of the main dining area 11 adjacent to the serving bar 40 area are a plurality of serving carts 49 which may be stationary or mobile. These carts 49 will allow quick service by the waiters of items such as soups, canapes and the like and also mobile service of items such as desserts and coffees of various types. The carts 49 may be concealed behind planter boxes 60 of flowers to provide a neat appearance for the area. A similar arrangement of planter 60 and serving carts 49 is located at the rear of the main dining area 11.

In the lower right portion of FIG. 1, there are shown some of the ancillary spaces, including a passageway 63 and exit 64, an elevator 65 to the second floor, a storage room 66 for items such as art supplies and display equipment, an employees lounge and dressing room 67, and ladies' 68 and men's 69 rest rooms.

In the upper right portion of FIG. 1, there are shown a passageway 70 and exit 71, an elevator 72 to the second floor, and a series of the lockers 73 for use by the artists.

In the upper left portion of FIG. 1, there are shown an area 74 for sculpture display, an artists laundry and lavatory 75, a restroom 76 for employees, a kitchen office 77 and a service elevator 78 to the second floor. A ramp 79 up to the elevated floor area 12 is also provided. Service utensils may be stored in the area 80. A seating area 81 is provided for employees and a short flight 82 of two or so stairs provides entry into the rest room 76. Also located in this area is the "chef's corner", with preparation area 83, a dumb waiter 84 to the second floor, and a walk-in refrigerator 85. A counter 86 is provided adjacent the preparation area 83 for pick-up of food orders. An exit 87 is located adjacent the refrigerator area 85 in the serving area 13. A similar exit 88 is located at the lower left of FIG. 1, also in the serving area 13.

Also located on the first floor, as shown in the lower left portion of FIG. 1, are an elevator 89 to the second floor, men's 90 and ladies' 91 rest rooms, a supply room 92 and an office 93 for the management.

In the lower center portion of FIG. 1, there are shown the entrance 94 and exit 95 to the facility 10, with seats 96 located along one side of the exit passage 97 and with a waiting area 98, including seats and a palette-shaped table, adjacent to the entrance 94. Ancillary spaces include a music and audio control area 99, an area 100 for valuables, cloak rooms 101 and 102 and a cashier area 103. A list of exhibitors is posted on a bulletin board 104 in the vicinity of the entrance way and a piano bar 105, with seats 106 located around the periphery thereof, is located in the front portion of the main dining area 11.

In FIGS. 1 and 3 there are shown the exhibit preview window booths 107 which extend outwardly from the front of the building on both sides and in the center area thereof. These window booths are for the purpose of providing a preview exhibit from various art media, with one window booth 107 being devoted to photography, for example, while other booths 107 are employed to exhibit acrylics, watercolors, sculpture and the like.

In FIG. 2 there is shown a schematic floor plan of the second floor, which is reached from the first floor by the various elevators previously mentioned in regard to the description of the first floor. Thus the elevators 65, 72, 78 and 89, as well as dumb waiter 84, all provide service from the first floor. It should be pointed out that stairs may be employed between floors rather than elevators in one or more of these elevator locations, depending on personal preference and also the need to comply with local regulations.

It is the purpose of the second floor layout to provide an area for performance of other arts in addition to those described in connection with the first floor layout. Thus, for example, areas are provided for presentations of instrumental and vocal music, acting, poetry, dance, comedy and drama productions. These presentations may be scheduled at different times and in different areas as desired.

The second floor layout is arranged on four levels, with successive levels being slightly elevated or depressed relative to adjacent levels by a height equal to approximately two stairs. Located on the first or lowest level 109 of the second floor is a dance floor 110 of generally rectangular shape, with the long axis extending from front to back and having a plurality of palette-shaped tables 111 of the type described in connection with the first floor located around the periphery of the dance floor 110 at the front and along the sides thereof, shown in FIG. 2. Stages 112 and 113 are located at the rear of the dance floor 110 and an orchestra level 114 is elevated above the stages 112, 113 at the fourth level of the second floor. The orchestra level 114 is reached from the rear and side, as described hereinafter. At the front end of the dance floor 110 a flight 115 of two stairs leads up to the second level 116. Similar flights 115 are located on both sides of the first level 109 at the rear thereof and these flights 115 also lead up to the second level 116.

The second level 116 extends around the first level 109 on three sides and is separated therefrom by a wall 117 of a height equal to the height of the flight 115 of stairs. The second level 116 is primarily employed as a service area for serving diners at the tables 111 on the first level 109. Stationary service carts 118 are provided for this purpose along both sides of the second level 116. At these carts 118 there are available such items as various cheeses, coffees, canapes and consommes, with individual carts being generally devoted to one of such items. Seats 119 are located along the sides of the second level for use by the waiters when they are not occupied with serving. The backs of such seats should face toward the dining tables 111 so that the seated waiters are obscured from the view of the dining patrons and those on the dance floor. Along the front area of the second level 116 there are located service booths 120 for use by the waiters and bus boys.

In the upper right portion of FIG. 2, there are shown some of the ancillary spaces on the second level 116, including a passageway 121 which extends from the vertical wall 125 defining the right side of the stage 113 and orchestra area 114 in an L-shaped configuration to an emergency exit 122 at the rear of the building. Seating 123 and service 124 areas are located on the sides of the passageway 121. To the right of the passageway 121 are located successive doors 126, 127, 128 leading, respectively, to an artists' locker room 129 with lockers 130, an elevator 72 to the first floor, and a space 131 which may be used as an artists rest and dressing area, or for storage. Between the passageway 121 and the orchestra area 114 are located a door 132 leading to a cashier's offices 133, 134 with connecting doors 135, 136 leading back to the passageway 121 adjacent the exit 122. A safe 137 may be located in the office 133. At the end of the passage 121 adjacent the stage 113 there is located a door 138 connecting to a passageway 139 which extends to a flight of four stairs 141 leading up to the orchestra area 114 which is on the fourth level 142. Adjacent to the passage 139 on the right side thereof are a musicians locker room 143 with lockers 144 and a lounge area 145 with seating 146.

In the upper left portion of FIG. 2, there are shown additional ancillary spaces on the second level 116, including a passageway 150 which extends directly to the rear of the second level serving area to the left side of the dance floor 110. The passage 150 leads to an emergency exit 154 at the rear of the building. A seating area 151 is located to the right of the passage 150 across from the stairs 115. Also on the right side of the passage 150 are a door 152 leading to the elevator 78 and a door 153 leading to a restroom 155. A group of seats 156 are located between the doors 152 and 153. A restroom 157 for musicians and artists is also located adjacent restroom 155, with stairs 158 leading to the orchestra area 114. The orchestra area 114 is provided with wings 159, 160 on the right and left side, respectively, as viewed from the audience, and the left wing 160 serves as a make-up wing, with a bench 161 and sink 162 provided for this purpose.

On the left side of the passageway 150 there is located a counter 170 for order pick-up and a door 171 leading to a food preparation area 172, with table 173, walk-in refrigerator 174, and a dumb waiter 84 to the first floor. A work counter 175 extends around the interior of the walls of the preparation space 172.

In the lower right portion of FIG. 2, there is shown the extension of the second level 116 as a passageway 180 leading to an emergency exit 181 from the right side of the building. On the right side of passageway 180 there are located doors 182, 183, 184 and 185 leading, respectively, to a ladies' room 186, men's room 187, a storage room 188 and the elevator 65.

In the lower left portion of FIG. 2, there is shown a door 189 leading from the service area of the second level 116 to an apartment 190 to be used by a visiting professor or other person as living quarters. Included in the apartment 190 are a convertible living room 191 and a kitchen 192, with awning 193. The kitchen 192 includes a stove 194 and refrigerator 195. Beyond the kitchen 192 there is located a bathroom 196. Adjacent the front door 189 of the apartment is a large walk-in closet 197 which is entered through door 198. A seating area 199 is located across from the door 189 in the service area. The living room 191 is provided with a double door arrangement 200 leading to a balcony 201 which projects out from the front wall 202 of the facility 10. The balcony 201 is also shown in FIG. 3. A false balcony 203 is constructed at the opposite end of the front of the facility 10, and attached to the front wall 202 adjacent the men's room 187 and ladies' room 186, as shown in FIGS. 2 and 3.

The second floor also includes a third level 204, including three portions **204*a*, 204*b* and 204*c* thereof, located at the front and left and right sides, respectively, of the second floor, as shown in FIG. 2. The front portion 204*a* is located between the outer front wall 202 and the second level 116 and is reached from the second level 116 via either of two sets of two stairs 205 located at either end of the third level 204*a*. Level 204*a* serves as a dining area, with a plurality of palette-shaped tables 111, along with chairs therefor, being located on the level 204*a*. At the center of the front wall 202 of area 204*a*, there is provided a balcony 205 which is built into the wall 202, and with a two stair 206 step-down to the balcony level, thus placing balcony 205 on the same level as balconies 201 and 203**.

Third level area **204*c* on the right side of the second floor is located between the service second level 116 to the right of the dance floor 110 and the outer wall 31 on the right side of the facility 10. This area 204*c* is also reached from the second level 116 by two sets 208 of two stairs located at either end of the area 204*c*. Area 204*c* is also provided with a plurality of palette-shaped dining tables 111, with chairs, to allow area 204*c*** to function as a dining area.

Third level area **204*b* on the left side of the second floor is located between the service second level 116 to the left of the dance floor 110 and the outer wall 41 on the left side of the facility 10. This area 204*b* is reached from the second level 116 by two sets 210 of two stairs located at either end of the area 204*b*. Area 204*b* is provided with a plurality of serving bars 40 similar to the bars 40 which are employed on the first floor. At the upper end of area 204*b* there are located a bar 207 and a service area 209. Emergency exits 211 and 212 are located at the upper and lower ends of area 204***b*. Also at the lower end of area 204 there are located a ladies' room 213 and a men's room 214, and a door 215 leading to the elevator 89.

The stairs which are, in general, employed in groups of two to define the various levels, may be of any standard height, such as about 8 inches. The distance between the first level of the first floor and the first level of the second floor may be of any convenient height, such as about 16 feet.

In FIG. 3 there are shown awnings 220 of various sizes which may be secured to the front wall 202 of the building structure and extend out over the window booths 107 and also over the balconies 201, 203 and 205. Various decorative signs (not shown) such as, for example, signs displaying theatrical masks, a dance team and a musical staff, may be attached to the outer front wall 202 over the balconies at the front of the building. In addition, a sign (not shown) stating the name of the club or facility 10 may be attached to the outer front wall 202. Possible locations for such decorations and signs are shown as item 221 in FIG. 2. The facility 10 is provided with a roof 222 which may be of any suitable construction, and with decorative features as desired.

The use of various levels for both the first and second floor is advantageous in allowing maximum viewing of artist exhibits and stage presentations throughout the facility 10. In addition, the use of various levels facilitates movement of people through the facility 10.

Unless otherwise stated, the various rooms and floor areas discussed herein are constructed in accordance with conventional construction practices so that, for example, a room will be understood to include floor, ceiling and walls of a conventional nature. Similarly, where a room is designated for a specific purpose, such as a men's or ladies' restroom, it will be understood that such a room will include those components, of a conventional nature, which will allow the room to fulfill such purpose. Furthermore, the building structure itself is of a conventional nature and may be of any suitable building materials which will provide a building of durable construction for the intended purpose as described herein.

It is thought that the invention and many of its attendant advantages will be understood from the foregoing description, and it will be apparent that various changes may be made in the form, construction and arrangement of the parts without departing from the spirit and scope of the invention or sacrificing its material advantages, the forms hereinbefore described being merely preferred embodiments thereof.

It is claimed:

1. A building structure which houses a restaurant with integral artist work area and exhibit area, comprising: an enclosed space defining at least one restaurant dining area having a plurality of dining tables located therein and with access from outside the building to allow dining customers to proceed to and from said dining area; an enclosed space defining a plurality of artist work areas located around the periphery of the restaurant dining area, each of said work areas having means for working in a particular art medium which is separate and distinct from the art mediums in the other work areas, each of said work areas further having means for exhibiting works of art; means for communicating the dining area with the artist work areas to allow access between said dining area and said artist work areas and also to allow observation of the artist work areas by dining customers in the dining area; means for cleaning the air in said artist work area to prevent dust particles and odors from being transmitted to the dining area; at least one food preparation and serving area adjacent said dining area; and means for communicating the dining area with the preparation and serving area.

2. The building structure of claim 1, wherein said artist work area is located on the opposite side of said dining area from the food preparation and serving area.

3. The building structure of claim 2, wherein said artist work area is located on a level elevated above the dining area.

4. The building structure of claim 2, wherein said food preparation and serving area is located on a level elevated above the dining area.

5. The building structure of claim 1, wherein said food preparation and serving area includes a plurality of serving bars arranged in a line along the periphery of the dining area.

6. The building structure of claim 5, wherein a plurality of artist work areas is located in a line along one side of the dining area, and said plurality of serving bars is located in a line along the opposite side of the dining area.

7. The building structure of claim 1, wherein said structure includes a first floor and a second floor, with means for practicing at least one of the art disciplines being located on the first floor, and with means for practicing at least one of the performing arts being located on the second floor.

8. The building structure of claim 1, wherein at least one of said dining tables has its upper surface in the shape of a palette.

* * * * *